United States Patent [19]

Madewell et al.

[11] 4,314,672

[45] Feb. 9, 1982

[54] BEVELING TIP

[75] Inventors: Tommy J. Madewell, Argyle; Ben F. Jezek, Jr., Tioga, both of Tex.

[73] Assignee: Victor Equipment Co., Denton, Tex.

[21] Appl. No.: 189,340

[22] Filed: Sep. 22, 1980

Related U.S. Application Data

[63] Continuation of Ser. No. 57,401, Jul. 13, 1979, abandoned.

[51] Int. Cl.[3] ..... B05B 7/06

[52] U.S. Cl. ..... 239/424; 239/552

[58] Field of Search ..... 239/424, 424.5, 489, 239/419.3, 552, 589, 600, 601, 434.5, 400, 404; 29/157 C

[56] References Cited

U.S. PATENT DOCUMENTS

| | | | |
|---|---|---|---|
| 2,468,824 | 5/1949 | Hughey | 239/552 |
| 2,531,006 | 5/1950 | Smith | 239/552 |
| 3,088,854 | 5/1963 | Spies | 239/424 |
| 3,526,366 | 9/1970 | Rothrock | 239/552 X |
| 3,575,354 | 4/1971 | Hach | 239/424.5 |
| 3,928,084 | 12/1975 | Etter | 239/424 X |

*Primary Examiner*—Robert B. Reeves
*Assistant Examiner*—Gene A. Church
*Attorney, Agent, or Firm*—James C. Fails

[57] ABSTRACT

What is disclosed is a tip for a cutting torch for beveling steels at angles greater than 45° with respect to the perpendicular and characterized by an inner piece having a cutting oxygen aperture drilled through the center and fluted around its periphery and conformably fitting within an outer piece, the outer piece extending beyond the inner piece and with an exit diameter smaller than the chamber downstream of the inner piece and with critical relationships between the diameter of the exit aperture, the cutting oxygen aperture and diamensions of the chamber defined downstream of the inner piece and upstream of the exit aperture of the outer piece such that a bulbous flame is obtained at the tip of the outer piece that will cut smoothly at beveled angles of from 45° to 90° with respect to the perpendicular.

3 Claims, 6 Drawing Figures

BEVELING TIP

This is a continuation of application Ser. No. 057,401, filed July 13, 1979, now abandoned.

BACKGROUND OF THE INVENTION

1. Field of the Invention

This invention relates to cutting torch tips. More particularly, this invention relates to a cutting torch tip that can be employed for beveling high strength steels as well as common carbon steels when cutting at angles greater than 45° with respect to the perpendicular and produce a smooth cut.

2. Description of the Prior Art

The prior art has seen the development of a wide variety of torch tips, including cutting torch tips. As is recognized, cutting oxygen passes through an orifice, usually centrally located, in the tip. Surrounding the orifice are a plurality of smaller orifices called preheat orifices that pass a mixture of fuel gas and oxygen to preheat the metal for cutting. The admixture of fuel gas and oxygen burn to insulate the cutting oxygen from contamination by surrounding air. Consequently, the preheat orifices must be located precisely around the cutting orifice in a proper orientation. Torch tips for these features have in the past been made by three basic methods producing two basic styles of tips.

The older style is a single piece torch tip. One way of making this style of tip is by drilling. First, a solid blank of material, such as copper, is shaped in the form of a torch tip. Next, the cutting orifice and the preheat orifices are formed in the blank by drilling. Since drilled holes are limited in the minimum diameter obtainable, it is often desirable to make the orifices smaller. This improves combustion properties such that the fuel gas burns more efficiently, heating the work piece better. In this method, holes have also been formed by inserting piano wires in the drill holes and swaging the tip around the wires, then pulling the wires free. The problem with this method is that it is slow, the drills do not drill straight enough to optimally locate the orifices and the drills frequently break. Moreover, the number of preheat orifices that can be located about the cutting orifice is limited because of the disadvantages of this method. Another method of making single piece type torch tip is by swaging or drawing together two separate pieces. U.S. Pat. Nos. 3,716,902, and 2,254,757 reveal such a method. This method is less expensive than the first but also has problems in that the number and shape of the preheat orifices is still limited and the precise orientation of preheat orifices is less than optimal.

The other style of torch tip is a two piece design. An example of this type of tip is revealed in U.S. Pat. No. 2,468,824. The outer piece of this tip is made by forming a shell of smooth interior. The inner piece is made by milling rectangular slots in the exterior of a blank piece of metal and drilling a cutting orifice through the center thereof. The smooth inner surface of the outer piece and the mill slots of the inner piece combine to form the preheat orifices. This method is advantageous in that an increased number of preheat orifices is possible. In the prior art of this type, however, the tips not been satisfactory when trying to form a smooth, beveled cut where the degree of bevel is more than 45° with respect to the perpendicular; for example, in the range of 45°-90° with respect to a vertical plane when the work surface is horizontal. Apparently, there has been a concentrated flame from which the heat was reflected from the cutting surface of the work piece such that even if cutting was possible at all, it was a ragged cut that had to supplementarily processed; particularly, with high strength steels.

Typical of other prior art patents are U.S. Pat. Nos. 3,838,820; 3,558,062; 2,351,787; 1,731,265; and 1,186,962. These patents were thought to have possibilities; but when tested they all developed the same reflecting heat problem such that even where a beveled cut was possible, it was a jagged cut that required supplemental working.

From the foregoing, it can be seen that none of the prior art torch tips produced a type flame that would bevel and produce a smooth cut when the angle of bevel was between 45°-90° with respect to the perpendicular, or line perpendicular to the surface of the work piece at the point of beveling.

SUMMARY OF THE INVENTION

Accordingly, it is an object of this invention to provide a torch tip that can be employed in a cutting torch and effect a beveled cut that is satisfactorily smooth and alleviate the difficulties of the prior art.

It is a specific object of this invention to provide a torch tip that produces a bulbous flame that does not reflect off the work piece to too great a degree; and produce a relatively smooth beveled cut even at angles greater than 45° with respect to the perpendicular.

These and other objects will become apparent from the descriptive matter hereinafter, particularly when taken in conjunction with the appended drawings.

In accordance with this invention there is provided a torch tip for use with a cutting torch in beveling high strength steels at angles greater than 45° with respect to the perpendicular, or less than 45° with respect to the tangentto the surface of the work piece at the point of beveling; the torch tip comprising:

a. an inner piece having a plurality of slots, or grooves, preferably eight or more spaced equally around the periphery of its effluent end and extending toward its other end a sufficient distance to terminate in a chamber to which fuel and oxygen are supplied for preheating; having a plurality of longitudinally extending apertures for supplying preheat fuel and oxygen; the inner piece conformably fitting interiorly of an outer shell; the inner piece having a centrally disposed cutting oxygen passageway penetrating longitudinally therethrough; the cutting oxygen passageway having a diameter dco; the inner piece terminating in a squared off effluent end and having its other end conformingly coengaging an inner end of an outer shell and adapted to be sealingly received within the cutting torch;

b. an outer shell disposed concentricly about said inner piece and conformingly coengaging said center piece adjacent its inner and effluent ends, having a generally tubular configuration with an outer frusto conical section toward its effluent end, having its other end engaging said other end of said inner piece and adapted to be spealingly received in the cutting torch; the outer shell having a chamber passageway larger in diameter than said inner piece therealong so as to define an annular chamber for preheat fuel and oxygen; the outer shell having a second passageway conformingly receiving the first end of said inner piece and its slots so as to define preheat apertures; the outer shell extending beyond the effluent end of said inner piece so as to define an effluent chamber having a first section, such as a cylindrical section of diameter du, and at least one frusto-conical section downstream of the cylindrical section; and having an exit diameter de smaller than the upstream diameter du of the effluent chamber; the outer shell having at least one frusto conical section making the transition from the effluent chamber diameter du to the exit diameter de; the effluent chamber having a length L no greater than du;

such that operationally the combination produces a bulbous flame that will satisfactorily smoothly cut high strength steel at a bevel angle within the range of 45°-90° with respect to the perpendicular line at the line of beveling. The details of constructing the torch of this invention are described in the preferred embodiment later herein.

DESCRIPTION OF THE PREFERRED EMBODIMENTS

Figure 1:
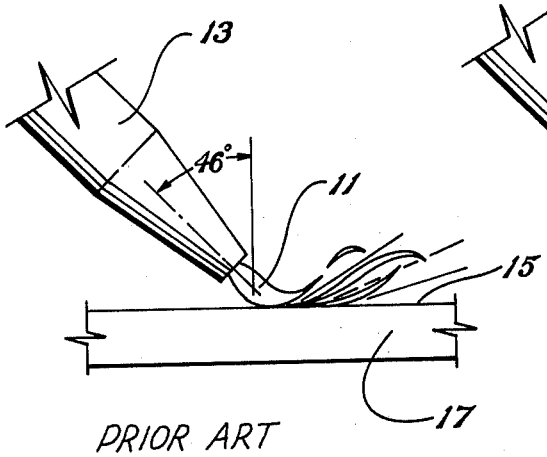
FIG. 1 is a partial side elevational view showing a cutting torch tip of the prior art.
Figure 2:
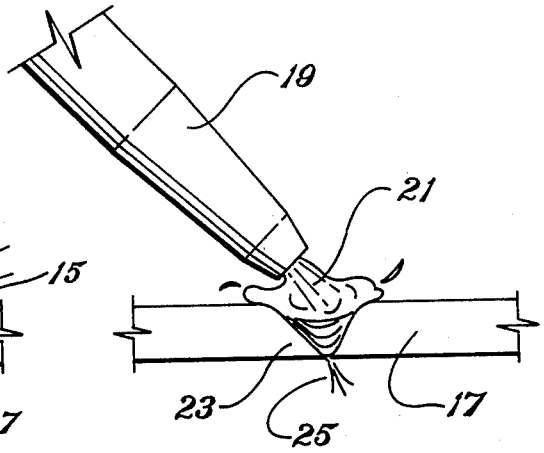
FIG. 2 is a partial side elevational view showing the cutting torch tip of this invention.

The technology of properly designing and manufacturing cutting torch tips is less a science and more an art. The reasons why certain things work are not fully understood. For example, as shown in FIG. 1, cutting torch tips that work satisfactorily at angles approximating the perpendicular, or less than 45° with respect thereto, cease to work satisfactorily when the angle becomes 45° or greater. The reason is not completely understood but appears to be related to the fact that the slim flame 11 emanating from the torch tip 13 is reflected from the surface 15 of the work piece 17. Even if the tip is made large enough that sufficient heat could be generated to cut the steel plate of the work piece 17, the cut will be uneven, jagged and not satisfactory.

In contrast, with the tip 19 of this invention, the flame is a bulbous flame 21 that produces a satisfactory bevel 23 in the work piece 17. Moreover, the tip will cut completely through the high strength steel plate readily, as shown by the effluent molten steel 25.

Figure 3:
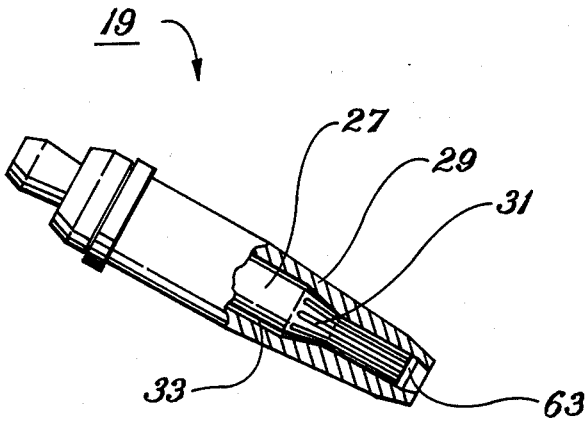
FIG. 3 is a side elevational view, partly in section, of the cutting torch tip of this invention.

The invention may be understood completely by referring to FIGS. 3-6. Referring to FIG. 3, the torch tip 19 is shown assembled ready to be included in the cutting torch (not shown). The torch tip 19 comprises the inner piece 27 and the outer shell 29. The two pieces are ordinarily formed of similar materials. For example, the outer shell may be formed of highly heat conductive copper and the inner piece formed of brass so as to resist oxidation, conduct heat away from the tip readily, and the like. Other materials may be employed in the construction of the pieces as long as they will meet the exacting requirements of the cutting torch tips.

Figure 5:
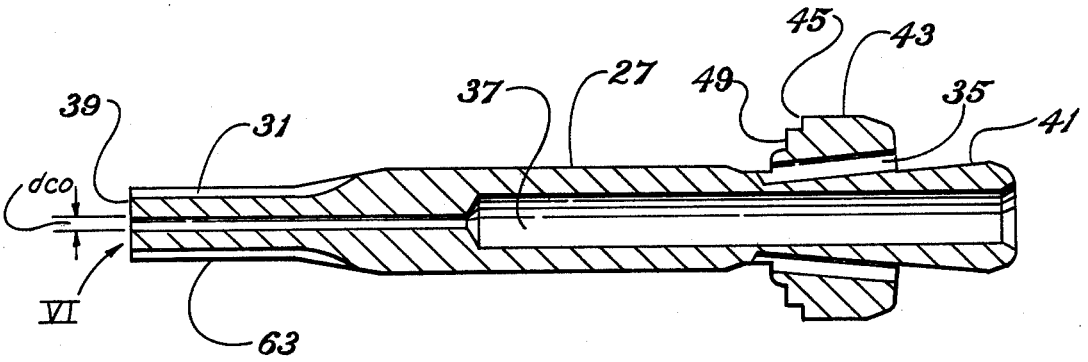
FIG. 5 is a cross sectional view of the inner piece of the torch tip of FIG. 3.
Figure 6:
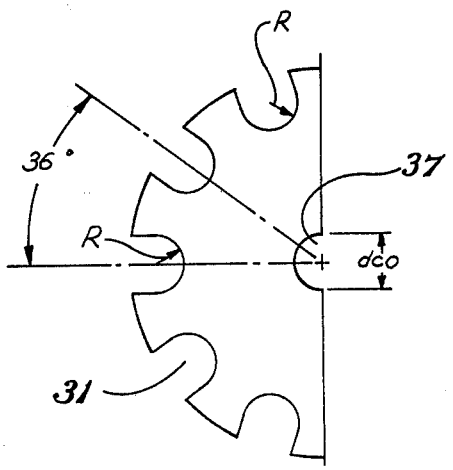
FIG. 6 is a partial end view of the inner piece of FIG. 5.

The inner piece 27 has a plurality of slots, or grooves, 31, FIGS. 3 and 5, spaced equally around the periphery of its effluent end. The grooves 31 extend toward its other end a sufficient distance to terminate in a mixing chamber 33 to which is supplied preheat fuel and oxygen admixed. The grooves, or slots, 31, as can be seen in FIG. 6, have a full radius bottom having a radius R. The sides of the grooves 31 are disposed parallel with each other and at a distance of 2R from each other. In the embodiment illustrated in FIG. 6, there are ten such grooves 31 that are disposed apart at 36°, centerline to centerline. Slots may be milled into the inner piece 27 before the cutting oxygen aperture is drilled therethrough. Near the other end, the center piece 27 has a plurality of apertures 35 drilled longitudinally thereof for supplying preheat fuel and oxygen admixture into the mixing chamber 33.

The inner piece 27 has a centrally disposed passageway 37, FIGS. 5 and 6 for cutting oxygen. The cutting oxygen passageway 37 penetrates longitudinally through the center piece 27 and has a diameter dco at the effluent end. The passageway 37 may be larger at its other end.

The inner piece 27 terminates in a squared off end 39 at the effluent end and has its other end conformingly coengaging an inner end of the outer shell 29, all adapted to be sealingly received within the cutting torch. The other end 41 of the inner piece is adapted to be sealingly received in the cutting torch so as to allow the cutting oxygen to proceed down the cutting oxygen passageway 37 while the admixture of fuel and oxygen preheat is passed through the annular passageway. The inner piece 27 has a shoulder 43 that comprises an outer annular step shoulder 45 for engaging the outer rim 47 of the shell, FIG. 4. The shoulder 43 has a second stepped shoulder 49 for engaging the recess shoulder 51 interiorly of the ring 47 of the outer shell 29, FIG. 4.

The outer shell 29 has generally tubular configuration and is disposed about the inner piece 27 with the respective ends in coengaging relationship. The outer shell 29 has a frusto conical section 53 toward its effluent end. In fact, as illustrated, it has a first frusto conical section of a somewhat greater angle frustum than a second section 55.

As indicated hereinbefore, it has its other end 57 adapted to conformingly coengage the other end of the inner piece by the respective rings and shoulders 45, 47, 49 and 51. The other end 57 is adapted to be sealingly received within the cutting torch, as is the other end 41 of the inner piece.

Figure 4:
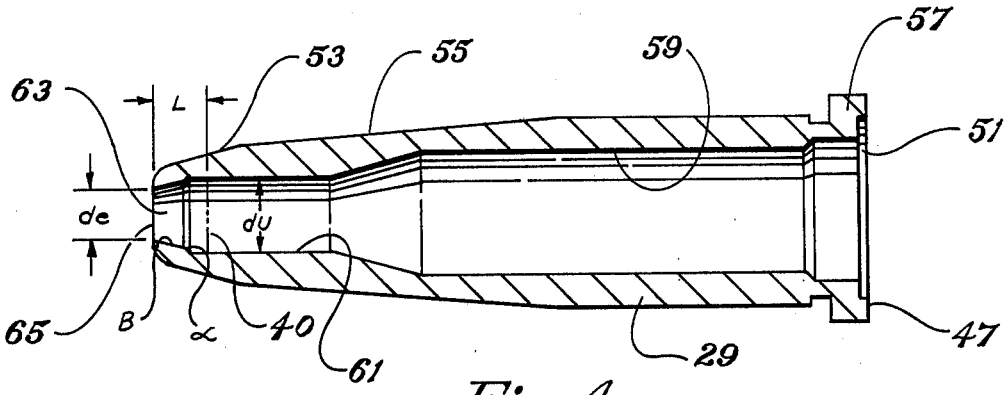
FIG. 4 is a magnified cross sectional view of the outer shell of the torch tip of FIG. 3.

The outer shell has a chamber passageway 59 that is larger in diameter than the inner piece along this section when the two are conformingly coengaged for operation. Consequently, an annular chamber 33 is formed for the preheat fuel and oxygen admixture. The outer shell has a second passageway 61 conformably receiving the first end 63, FIG. 5, of the inner piece 27 so as to define, in combination with the slots 31, preheat apertures. The outer shell extends beyond the effluent end of the inner piece; shown in phanton line 40, FIG. 4; so as to define an effluent chamber 63, FIGS. 3 and 4. As illustrated in FIGS. 3 and 4, the chamber 63 has a first section defined by interior walls of the outer shell 29 at a first angle and having a diameter du and at least one frusto-conical section downstream thereof defined by interior walls of the outer shell 29 at a second angle greater than the first angle. The angles are measured with respect to longitudinal axis of the outer shell and are within the range of 0°–90°, inclusive. In FIG. 3, the chamber includes a cylindrical section, the walls of which are at 0° angle, and a downstream frusto-conical section, the walls of which are at an angle greater than 0°. As can be seen in FIG. 4 there is also a small frusto-conical third section at an angle alpha ($\alpha$) that is greater than beta ($\beta$). As illustrated the angle alpha is about 30° with respect to the longitudinal axis of the outer shell and the angle beta is greater than ten degrees but less than thirty degrees. The outer shell has an effluent aperture 65 having a diameter de smaller than the diameter du of the effluent chamber 63 upstream thereof.

The effluent chamber has a length L that is less than the diameter du, although it is at least twice as great as the length of any chambers formed by extensions of shells in the torch tips of the prior art.

In manufacturing the torch tips 19, it has been found that the diameter of the section 63 of the inner piece and the diameter du of the second passageway 61 of the outer shell can be made relatively constant. Moreover, the length L of the effluent chamber 63 can be maintained relatively constant. Greater or lesser cutting capacity and inverse sensitivity can be achieved by altering the diameter of the cutting oxygen passageway dco and the diameter of the exit aperture de. For example, in the specific series of cutting torch tips, it has been found that the slots that have been employed can be 0.038 inch in diameter with a full radius bottom of 0.019 inch radius; the diameter of the section 63 of the inner piece can be about 0.26 inch and the diameter du about 0.2615–0.2635 inch. The following table gives an example of how the diameter of the cutting oxygen passageway at the effluent end necessitates a variation in the diameter of the exit aperture if the cutting torch of this invention is to function properly.

TABLE

| DCO | DE |
|---|---|
| 0.121 inch (in.) | 0.196 in. |
| 0.100 in. | 0.190 in. |
| 0.080 in. | 0.185 in. |

It is noteworthy that each time the diameter of the cutting oxygen torch tip increases by a factor of about 0.02 inch, the diameter of the effluent aperture must increase about 0.06 inch. It also appears that the ratio of the diameter of the cutting oxygen passageway to the diameter of the effluent aperture must be in the range of about 0.4–0.7.

From the foregoing it can be seen that this invention is advantageous in providing torch tips that can be employed with cutting torches to cut at a beveled angle in the range of 45°–90° with respect to the perpendicular to the surface of the work piece at the location where the bevel is to be cut. It thereby accomplishes the object delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

We claim:

1. A cutting torch tip for cutting torch for beveling steel cuts comprising:

a. an inner piece having a plurality of grooves spaced equally around the periphery of its effluent end and extending toward its other end a sufficient distance to terminate in a chamber to which an admixture of preheat fuel and oxygen are supplied in operation; said inner piece having a plurality of longitudinally extending apertures for supplying the preheat fuel and oxygen; said inner piece being conformingly fitted at each end interiorly of an outer shell; said inner piece having a centrally disposed cutting oxygen passageway penetrating longitudinally therethrough; said cutting oxygen passageway having a diameter dco; said inner piece terminating in a squared effluent end and having its other end conformingly coengaging a longitudinally inner end of an outer shell and adapted to be sealingly received within the cutting torch;

b. an outer shell having a generally tubular configuration with an outer frusto conical section toward its effluent end, having its other end coengaging said other end of said inner piece and adapted to be sealingly received within said cutting torch; said outer shell having a chamber passageway larger in diameter than said inner piece therealong so as to define an outer annular said chamber for fuel and oxygen for preheating; said outer shell having a second passageway conformably receiving said first end of said inner piece and said grooves so as to define preheat apertures; said outer shell extending beyond the effluent end of said inner piece so as to define an effluent chamber and having an effluent aperture having an exit diameter de smaller than the upstream diameter du of said effluent chamber; said outer shell having a portion defining said effluent chamber including a first section at a first angle and defining a diameter du and having at least one frusto conical section converging radially inwardly toward said effluent aperture at a second angle greater than said first angle, said angles being measured with respect to longitudinal axis of said outer shell and being in the range of 0°–30°, inclusive, and making the transition from said effluent chamber diameter du to said effluent diameter de; said effluent chamber having a length L no greater than the effluent chamber diameter du; such that operationally said tip produces a bulbous flame that will satisfactorily smoothly cut steel at a bevel angle within the range of 45°–90° with respect to the perpendicular line at the line of beveling.

2. The torch tip of claim 1 wherein said effluent chamber has two frusto conical sections downstream of said squared effluent end of said inner piece and making the transition from the effluent diameter du to the exit diameter de, both having angles greater than said first section, the innermost of the frusto conical sections having an angle of about 30° with respect to the longitudinal axis of said outer shell and the longitudinally outermost frusto conical section making an angle greater than 10° but less than 30° with respect to the longitudinally axis of the outer shell.

3. The cutting torch tip of claim 1 wherein said torch tip has the respective diameters dco and de about as follows:

TABLE

| DCO | DE |
|---|---|
| 0.121 inch | 0.196 inch |
| 0.100 inch | 0.190 inch |
| 0.080 inch | 0.185 inch |

* * * * *